United States Patent [19]

Breen et al.

[11] Patent Number: 5,044,286

[45] Date of Patent: Sep. 3, 1991

[54] PROCESS TO ELIMINATE PRODUCTION OF FLY ASH BY WET BOTTOM BOILERS

[75] Inventors: Bernard P. Breen, Pittsburgh; Robert A. Schrecengost, North Huntingdon, both of Pa.; James E. Gabrielson, Plymouth, MN.

[73] Assignee: Consolidated Natural Gas Service Company, Inc., Pittsburgh, Pa.

[21] Appl. No.: 447,789

[22] Filed: Dec. 8, 1989

[51] Int. Cl.[5] ..... F23J 1/00

[52] U.S. Cl. ..... 110/165 A; 110/264

[58] Field of Search ..... 110/165 A, 171, 264

[56] References Cited

U.S. PATENT DOCUMENTS

| | | | |
|---|---|---|---|
| 2,024,197 | 12/1935 | Bailey et al. | 110/165 A |
| 2,263,433 | 11/1941 | Allen | 110/165 A |
| 2,917,011 | 12/1959 | Korner | 110/165 A |
| 4,671,192 | 6/1987 | Hoffert et al. | 110/264 |
| 4,796,545 | 1/1989 | Hashizaki et al. | 110/165 A |
| 4,800,825 | 1/1989 | Kuenzly | 110/264 |

*Primary Examiner*—Henry C. Yuen

*Attorney, Agent, or Firm*—Buchanan Ingersoll

[57] ABSTRACT

A method of recycling fly ash as slag in a wet bottom furnace is described. The furnace may have a cyclone furnace, a pulverized coal furnace, or any other type of furnace producing wet slag. All or part of the collected fly ash is collected and returned to the furnace and combined with enough fuel to melt the ash. Melted ash directed against a wall, floor or side of the cyclone or furnace will flow to the bottom of the furnace so as to facilitate the liquid slag. The fly ash may be collected by an electrostatic precipitator, baghouse, cyclone (multiclone) or other device. The fly ash may be returned to the furnace or the cyclone using air, flue gas, steam, fuel, or other gas as a carrier.

17 Claims, 3 Drawing Sheets

PROCESS TO ELIMINATE PRODUCTION OF FLY ASH BY WET BOTTOM BOILERS

BACKGROUND OF THE INVENTION

1. Field of the Invention

The present invention relates to a process for reducing the production of fly ash in a wet slagging boiler. More specifically, the invention relates to melting substantially all of the fly ash and having it flow out of the furnace with the bottom ash.

2. Description of the Prior Art

In slagging furnaces it is desirable to increase the fraction of the ash which leaves the system as slag and decrease the fraction of the ash which leaves the furnace as fly ash. The reasons for increasing the fraction of ash removed as slag include: 1) the material is physically more stable than fly ash, 2) it is more dense than fly ash, 3) it is more marketable than fly ash, and 4) it does not "fly" through the boiler causing erosion.

Slag is more stable than fly ash. This is because slag is usually broken into pieces of from ½ inch diameter to 1/16 inch diameter, while fly ash typically has dimensions of 1/500 of an inch and less and will blow away as it is collected. For the same reason, water soluble materials are much more readily leached from fly ash. The smaller fly ash particles have a much higher surface area to volume ratio, and much more surface area is available for contact with water which leaches out water soluble materials (including small amounts of toxic metals) from the ash particle. For this reason, slag will almost always be regarded as a nonhazardous waste while fly ash of the same composition may be a hazardous waste.

The increased density of slag means that a greater weight of slag may be stored in the same volume or disposed of in the same landfill volume when compared to fly ash. Additionally, the slag will almost always be a stable fill while the fly ash might not be stable.

Fly ash has only a limited marketability. While it is useful as an extender for Portland cement and for concrete, only about 10% of the fly ash produced in the United States finds any market. Without a market, it must be disposed of at some expense. Slag is useful as an aggregate for concrete in various uses. It is useful as road bed material and as road surface material for certain applications. It is used as the aggregate in asphalt shingles. It is useful as blasting material for cleaning metal objects, rock or masonry objects. Notable among these blasting operations is the cleaning of ships. When slag replaces sand in "sand blasting" the risk for silicosis is greatly reduced. As a result of having these various uses and the fact that there is a limited supply of slag, about 75% of the boiler slag produced in the United States is sold for commercial use. The slag that is not sold is more easily disposed of than fly ash.

When fly ash is transmitted into molten slag, it is drained from the furnace. Fly ash, however, is swept through the furnace, the convective passes, super-heaters, steam reheaters, economizers and the air heater as dust, which erodes these components. While the erosion is sometimes slow enough to be harmless, it can be so rapid as to be catastrophic. Various techniques are practiced to reduce this erosion. Shields may be placed in front of tubes, or tube spacings may be increased and/or areas opened up to decrease particle velocity. Alternatively, the tubes may be constructed of specialty metals or have ceramic-type coatings installed thereon.

In addition to erosion, the ash builds up on surfaces, which reduces heat transfer and restricts gas flow. This buildup is often removed by the use of a soot blower. These soot blowers, however, are expensive to purchase, operate and maintain and at times may cause erosion themselves. It is thus more desirable to produce molten slag which is then quenched in water rather than producing fly ash.

The art has attempted to recycle fly ash in wet bottom furnaces. In this type of furnace, coal is burned and part of the ash fuses and runs from the furnace bottom as a liquid slag. The molten slag falls from the bottom of the furnace into water where it is quenched. The ratio between fly ash and bottom slag depends upon design and operating parameters and coal and ash characteristics. Cyclone fired boilers and some pulverized coal fired boilers have wet bottom furnaces, which drain the molten slag. Recognizing that some fly ash recycling occurs naturally in wet bottom furnaces, attempts have been made to use the same mechanism to recycle collected fly ash.

Fly ash is normally collected in electrostatic precipitators, baghouses or other suitable devices. The collected fly ash may thus be blown back into the furnace. In this case, the recycling improves efficiency by burning the carbon. To the extent that the recycled ash returns as fly ash, the process lowers the percent carbon in the fly ash, improving its marketability. To the extent the ash melts and flows from the furnace, the amount of fly ash which must be removed is reduced.

This technique does not result in the melting of all the recycled fly ash. Some of the recycled fly ash is blown back through the boiler and is once again collected in the particulate control equipment. Consequently, there is a need for a system which collects the fly ash so it can be melted and discharged as slag.

SUMMARY OF THE INVENTION

We provide a system for recycling fly ash in which substantially all of the recycled fly ash is melted and flows out of the furnace with the bottom ash. Collected fly ash is returned to the furnace by a carrier gas, usually air. As the fly ash and carrier stream is injected into the furnace a sufficient amount of auxiliary fuel, preferably natural gas, is mixed with the carrier to melt the fly ash. This stream of carrier auxiliary fuel and molten fly ash is directed to impact against the wall or floor of the cyclone or furnace. The molten fly ash will stick and flow, ultimately to the bottom of the furnace. In this manner, the fly ash will be converted to slag.

These and other advantages and features of the present invention will be more fully understood on reference to the presently preferred embodiments thereof and to the appended drawings.

DESCRIPTION OF THE PREFERRED EMBODIMENTS

Figure 1:
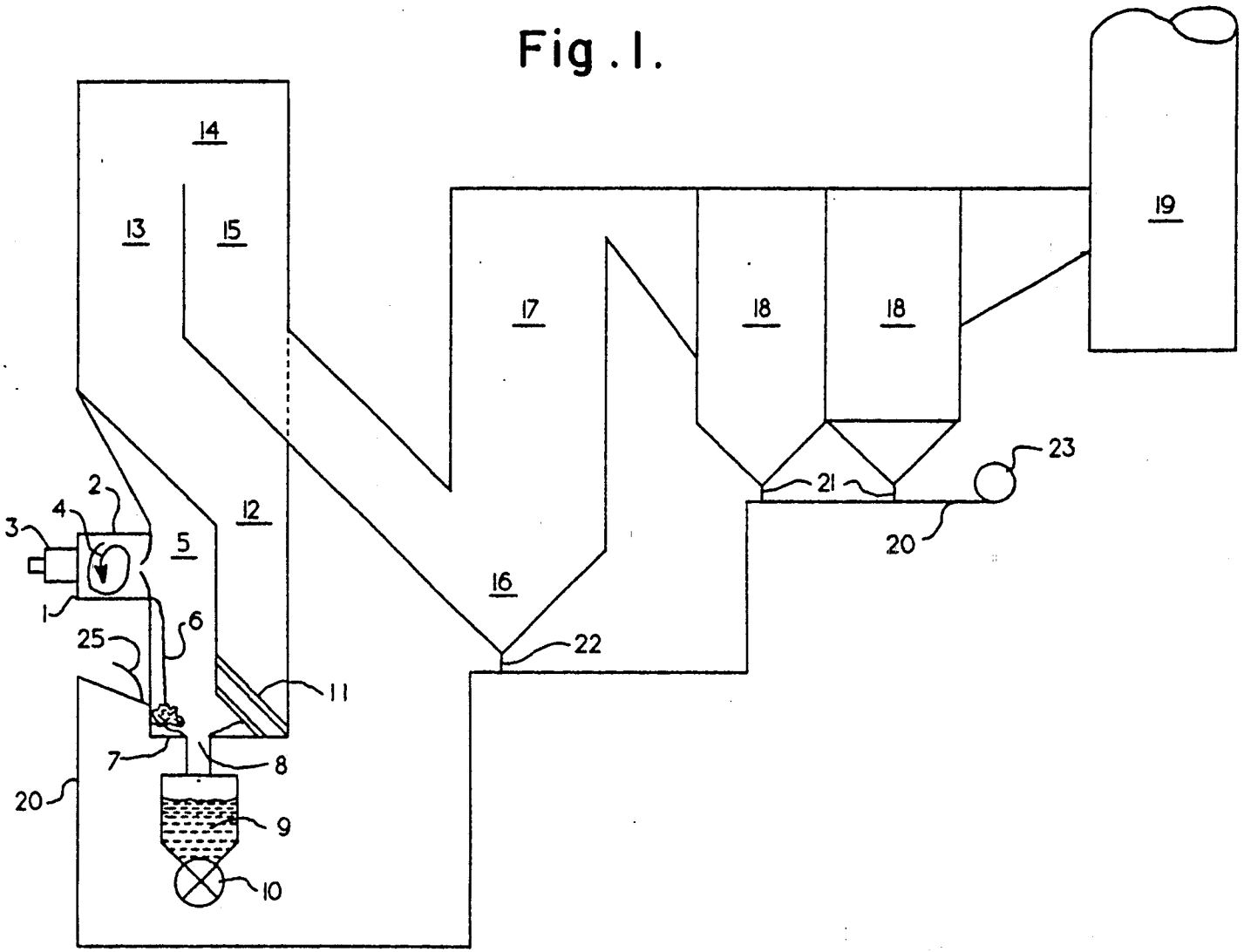
FIG. 1 is a diagram of a prior art furnace and boiler apparatus modified to use our method.

Referring to FIG. 1, a furnace having at least one cyclone is shown. A stream of crushed coal and primary air is fed into cyclone 1 through entry 3. The coal may be bituminous, anthracite, subitiminous, lignite or any combination thereof. Secondary air may also be introduced at inlet 2 to burn the coal. Arrow 4 indicates air flow. The combustion products along with some of the ash pass into the furnace 5, while much of the ash flows from the cyclone in a molten stream 6 to a pool at the bottom 7 of the furnace 5. The molten ash then flows as a stream or drips into a pool of water 9 where it solidifies. From the pool 9 the now solid slag is crushed and pumped by pump 10 along with carrier water to a stock pile (not shown) from which it is recovered for various uses.

Combustion gases and fly ash travel through screen tubes 11 into a secondary furnace 12 then to the superheater section 13, reheater section 14 and then into a economizer 15. Leaving the furnace, the combustion gases and fly ash enter a sharp turn 16 where some of the fly ash may be collected. From this point the fly ash and gas pass into the air heater 17, then into a dust collector 18 and from the dust collector into stack 19.

Our recycling process utilizes pressurized carrier gas in line 20 supplied by a fan or compressor 23 to educt the captured fly ash from the dust collectors 18 through conduits 21 and from the gravity collector 16 through conduit 22. The collected fly ash is then conveyed to the furnace 5 and directed at the furnace floor 7. The carrier gas may be air, flue gas, steam, or other gas, but is preferably air. Auxiliary fuel 25 is injected into the carrier gas 20 causing combustion and melting of the fly ash. The melted fly ash impinges on the floor 7 of furnace 5, and flows out the bottom 8 with the original slag. We have found that substantially all of the recycled fly ash is melted and flows out with the bottom ash. Our method can also be used for fly ash which has been collected in bags or other containers. The ash may be recycled from a baghouse, an electrostatic precipitator, a gravity separator such as a low spot in the duct work, a sharply curved duct or from a mechanical collector such as a cyclone collector or multiclone collector.

Figure 2:
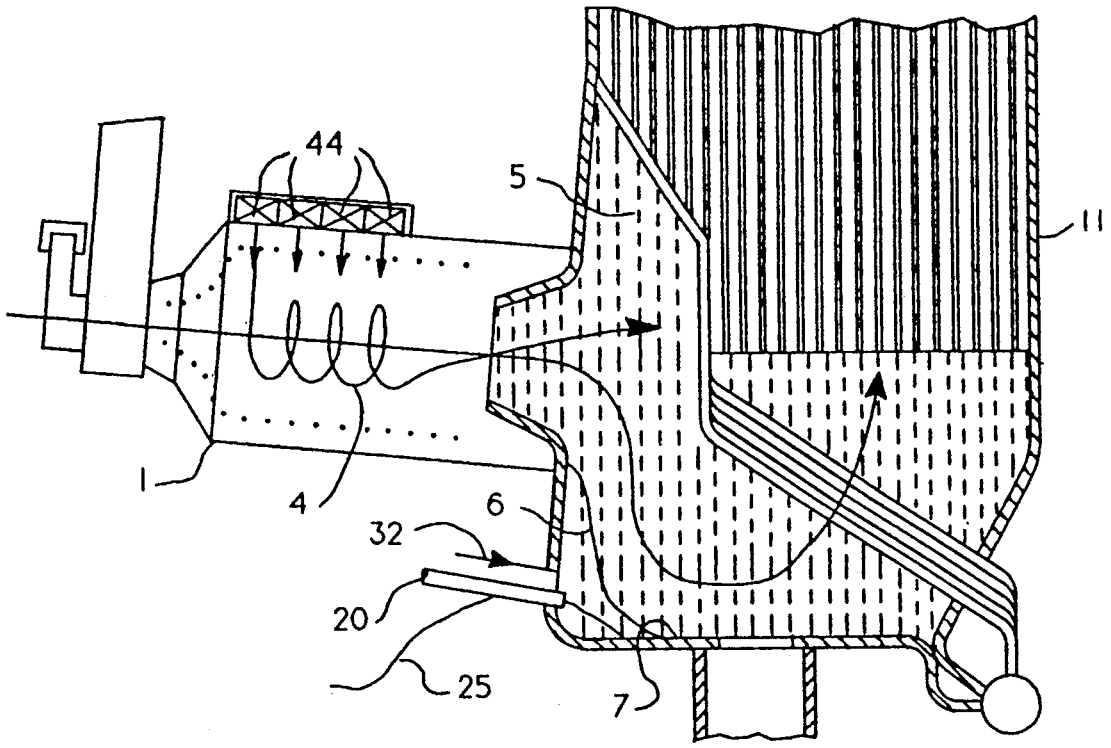
FIG. 2 is a more detailed diagram illustrating fly ash being recycled to the bottom of a furnace.

As illustrated in FIG. 2, the collected ash is injected into the furnace in a stream of carrier gas through a primary inlet 20. This stream is mixed with fuel through line 25, which is preferably natural gas, and with additional air if necessary which enters through a secondary inlet 32. The amount of additional air required may be 0.5 to 5 pounds per pound of fly ash. Combustion occurs which melts the fly ash. Inlets 20 and 32 are positioned to direct their streams against the furnace floor or wall. As can be seen from FIGS. 3 and 4, the fly ash could also have been introduced into the secondary furnace which is cyclone 1.

As the air and molten fly ash mixture in the carrier gas impacts the walls or floors of furnace 5, the molten fly ash will stick and flow, ultimately to the bottom 7 of the furnace 5. In order to melt the fly ash, enough fuel should be added to increase the temperature to above the ash fusion temperature of 1700–2600° F. The natural gas fuel required may be one to four cubic feet per pound of ash, allowing for losses or inefficiencies in the melting process. The fuel input which does not result in heating or melting the ash will be recovered in the boiler and will result in a savings of the primary fuel (coal).

Figure 3:
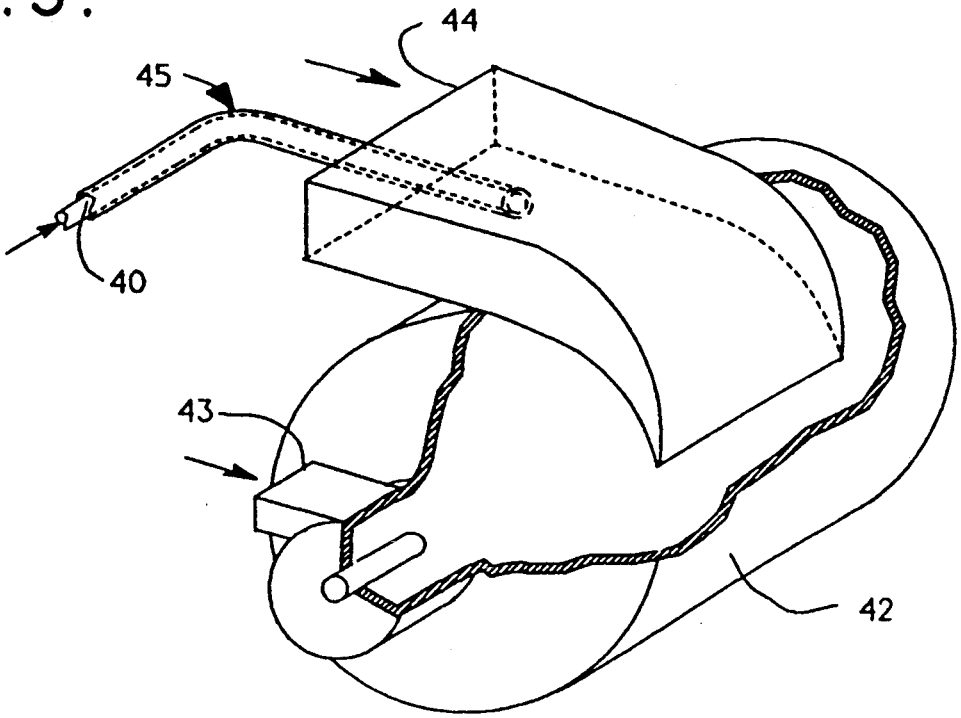
FIG. 3 is a diagram showing a cyclone furnace having fly ash being introduced tangentially, according to a second embodiment of the invention.
Figure 4:
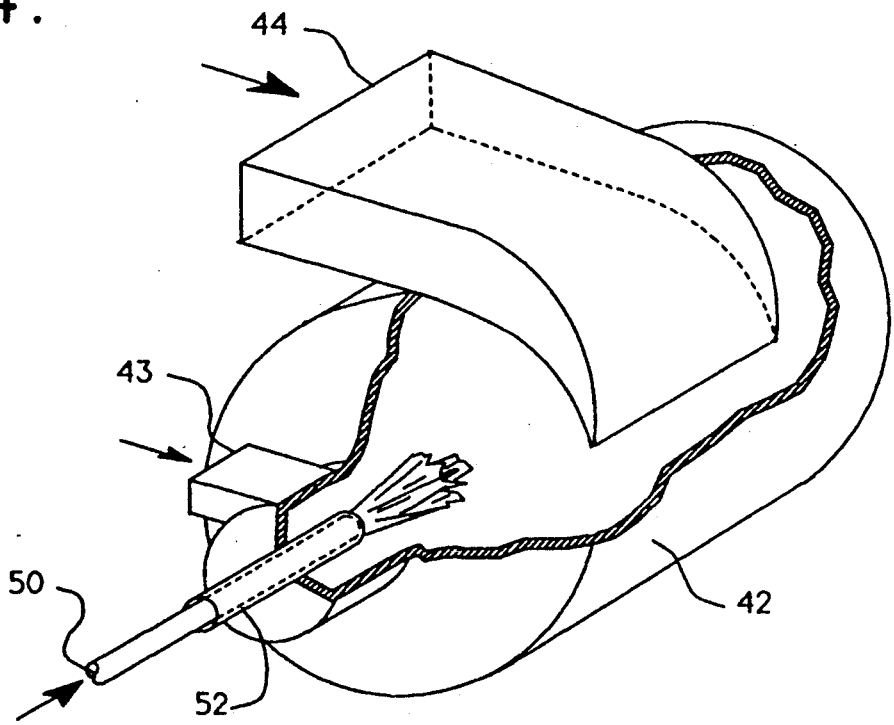
FIG. 4 is a diagram showing a cyclone furnace having fly ash being introduced centrally, according to a third embodiment of the invention.

Our method can also be used in cyclones as shown in FIGS. 3 and 4. In order to improve the removal of the ash as slag it is necessary for the stream of combustion products and fused ash to be directed against an inside wall or floor of the cyclone or at a pool of molten slag at the bottom of the furnace. The stream may enter the cyclone as part of a reactant stream, such as the secondary air (see FIG. 3). As the gas stream is deflected, the molten drops will impact the target and stick to it and be carried off as slag.

FIG. 3 shows ash in carrier gas passing through inlet 40 and being introduced tangentially into cyclone 42. Secondary air may enter through duct 44. Auxiliary fuel is injected around inlet 40 through inlet 45 and into the top of the cyclone 42. Inlets 40 and 45 are positioned to cause the molten ash to impinge on the side of cyclone 42. Secondary air may also enter through secondary inlet 43.

FIG. 4 shows the fly ash in carrier gas being injected through inlet 50 and auxiliary fuel being introduced through inlet 52. Both enter coaxially with coal that is injected through secondary inlet 43 into the center of cyclone 42. Secondary air is illustrated as entering cyclone 42 tangentially through duct 44.

The auxiliary fuel will not only melt the fly ash so it will be entrapped but it will cause the carbon in the fly ash to burn up. The fly ash will be converted to slag which can be sold for sand blasting, roofing shingle aggregate, icy road treatment to temporarily improve traction, and for aggregate for other uses.

When the particles are surrounded by a luminous flame they will melt in a very short time. The following times have been calculated:

TABLE 1

| Size (um) | Melting time (sec) | Travel distance required at 50 ft/sec |
|---|---|---|
| 5 | .005 | 0.25 ft |
| 50 | .01 | 0.50 ft |
| 100 | .02 | 1.00 ft |
| 200 | .04 | 2.00 ft |

It can thus be seen that small particles need to be in the flame for only a short time. Larger particles will settle out and need not be totally melted by a flame.

One pound of ash may require one pound of air as carrier gas. The air and ash may require 2000 BTU or 2 cubic feet of natural gas to melt the ash. This amount of natural gas is about 60% more than can be burned by the one pound of carrier air. The air shortage can be overcome by using 1.6 pounds of carrier air per pound of ash, adding secondary air, or relying on residual oxygen in the furnace to complete the combustion of the natural gas.

EXAMPLE 1

A 100 MW electrical generating unit with a heat rate of 9500 BTU/KWH firing 13,000 BTU/lb coal will use 73,000 lb/hour (36.5 t/hr) coal. If the coal is 10% ash and 40% shows up as fly ash the unit will produce 2920 lb/hour of fly ash. At 7000 hours/year operation this will be 20,440,000 lb or over 10,000 tons of fly ash annually. At a rate of 2 $ft^3$ of natural gas per pound of ash this would require about 40,000,000 $ft^3$/yr of natural gas. At $3 per thousand cubic feet the cost would be around $120,000 per year. If coal costs $1.5 per million BTU and 75% of the above gas goes to replace coal the net cost is $120,000−($40,000×0.75×1.5) or $75,000/year. On the other hand, the cost of disposal of 10,000 tons of fly ash may be as much as $400,000 and the value of 10,000 tons of bottom ash may be $50,000. Thus, a net savings of $375,000 per year can be made. In tabular form the savings are as follows:

TABLE 2

| | |
|---|---|
| Reduced Coal Costs | $ 45,000 |
| Reduced Fly Ash Disposal | 400,000 |
| Slag Sale | 50,000 |
| Natural Gas Cost | (120,000) |
| Net Savings | $375,000 |

While we have described certain present preferred embodiments of the invention, it is to be distinctly understood that the invention is not limited thereto but may be otherwise embodied and practiced within the scope of the following claims.

We claim:

1. A process for the reduction of fly ash in a wet bottom boiler of the type having a primary and secondary furnace, the process comprising the steps of:

(a) collecting the fly ash from one of an electrostatic precipitator, a bag house, a cyclone collector, a multi-cyclone collector, a gravity separator and a sharply curved duct;

(b) removing the fly ash in a stream of carrier gas into the furnace;

(c) adding a fuel to the stream of carrier gas and fly ash;

(d) introducing the carrier gas and fly ash and fuel into one of the primary and secondary furnaces, wherein the fuel and the heat from at least one of the surrounding gas and molten slag provide energy to melt the fly ash; and (e) discharging the melted fly ash with slag from the furnace bottom.

2. A process as described in claim 1 wherein the carrier gas is at least one gas selected from the group consisting of air, flue gas, natural gas, and steam.

3. A process as described in claim 1 wherein the fuel is natural gas.

4. A process as described in claim 1 wherein the fuel is at lest one fuel selected from the group consisting of coal and liquefied petroleum gas.

5. A process as described in claim 1 wherein the fuel used to melt the ash is introduced centrally within the fly ash and carrier gas.

6. A process as described in claim 1 further comprising the step of adding additional air to the fly ash.

7. A process as described in claim 6 wherein the additional air is added as a carrier gas for the fly ash.

8. A process as described in claim 6 wherein a portion of the additional air is residual oxygen from surrounding products of combustion.

9. A process as described in claim 1 wherein the furnace is one of a cyclone fired furnace and a pulverized coal fired furnace.

10. A process as described in claim 1 where coal is burned in the furnace and the coal is comprised of at least one type of coal selected from the group consisting of bituminous, anthracite, subitiminous, and lignite.

11. A process as described in claim 1 wherein the fly ash is directed toward a wall of the furnace.

12. A process as described in claim 1 wherein the fly ash is directed toward a floor of the furnace.

13. A process as described in claim 1 wherein the fly ash is injected into at least one cyclone having walls and a floor.

14. A process as described in claim 13 wherein the fly ash is injected tangentially into the cyclone furnace.

15. A process as described in claim 13 also comprising the step of injecting secondary air with the fly ash.

16. A process as described in claim 13 wherein the fly ash is introduced centrally into the cyclone.

17. A process as described in claim 13 wherein the fly ash is introduced centrally into the cyclone and directed toward the floor of the cyclone.

* * * * *